United States Patent [19]

Bernicot

[11] 4,181,461

[45] Jan. 1, 1980

[54] APPARATUS FOR OPENING DISPOSABLE PACKAGING

[75] Inventor: Jean B. Bernicot, Mulhouse, France

[73] Assignee: Vibramec S.A.R.L., France

[21] Appl. No.: 884,163

[22] Filed: Mar. 7, 1978

[30] Foreign Application Priority Data

Mar. 10, 1977 [FR] France ..... 77 07750

[51] Int. Cl.[2] ..... B65B 69/00

[52] U.S. Cl. ..... 414/412

[58] Field of Search ..... 222/81, 82, 83, 85, 222/404; 221/30, 31; 141/330; 30/2; 414/412

[56] References Cited

U.S. PATENT DOCUMENTS

| | | | |
|---|---|---|---|
| 2,067,583 | 1/1937 | Stark | 222/404 |
| 3,386,602 | 6/1968 | Kanarek | 214/305 |

FOREIGN PATENT DOCUMENTS

| | | | |
|---|---|---|---|
| 435989 | 3/1975 | U.S.S.R. | 222/81 |
| 477062 | 3/1976 | U.S.S.R. | 214/305 |

*Primary Examiner*—Francis J. Bartuska

*Attorney, Agent, or Firm*—Robert E. Burns; Emmanuel J. Lobato; Bruce L. Adams

[57] ABSTRACT

Disposable packaging containing a granular product is fed into a trommel by a screw whose discharge end is rigid with a frustoconical member located inside the trommel. The smaller end of the frustoconical member faces the screw. Cutters for releasing the product from the packaging are located at the inlet of the trommel and cooperate with the frustoconical member. The trommel has rakes or spiral members for separating the packaging and the product from each other.

6 Claims, 4 Drawing Figures

14
15
16
10
1
5
12
11
17
7
23
31
30
33
32
3
18
24
2
9
IV
III
II

APPARATUS FOR OPENING DISPOSABLE PACKAGING

This invention relates to apparatus for opening disposable packaging, such as sacks or bags.

A known apparatus for opening sacks or other disposable packaging containing a granular product of variable grain size comprises in combination means for progressively advancing the packaging containing the product, and separation means for directing the packaging towards a first outlet without tearing it to pieces and for directing the content to a second outlet after passing through screening means. The advancing means comprise a screw mounted for rotation in a trough of parabolic, elliptical, or other form, subjecting the packaging to progressive rolling and cutting for releasing the product and evacuating the empty packaging. The bottom of the trough comprises one or more longitudinal grooves or corrugations to improve rolling and advance of the opened packaging and the freed product.

An object of the present invention is to improve this apparatus. It has been found by tests that the grooves or corrugations formed in the bottom of the trough are insufficient to ensure proper opening of sacks and other packaging. Depending on the strength of the packaging material, the packaging slides over the grooves or corrugations without being torn. Moreover, it has been found that progressive advance of the packaging containing the product is too rapid and it has been necessary to provide means to brake this advancing movement. Moreover, if the products tends to stick, it is necessary to subject the packaging to repeated manipulation in order to obtain evacuation of the product.

The present invention provides apparatus for opening sacks or packaging to be discarded containing granular products having variable grain size, which comprises a screw for advancing the container-contents assembly, the screw having at its end located inside a trommel means for braking this advance movement cooperating with means for rolling the contents arranged at the inlet of the trommel provided with elements for separating and forwarding the container and the contents.

The invention will be described further, by way of example only, with reference to the accompanying drawings, in which.

Figure 1:
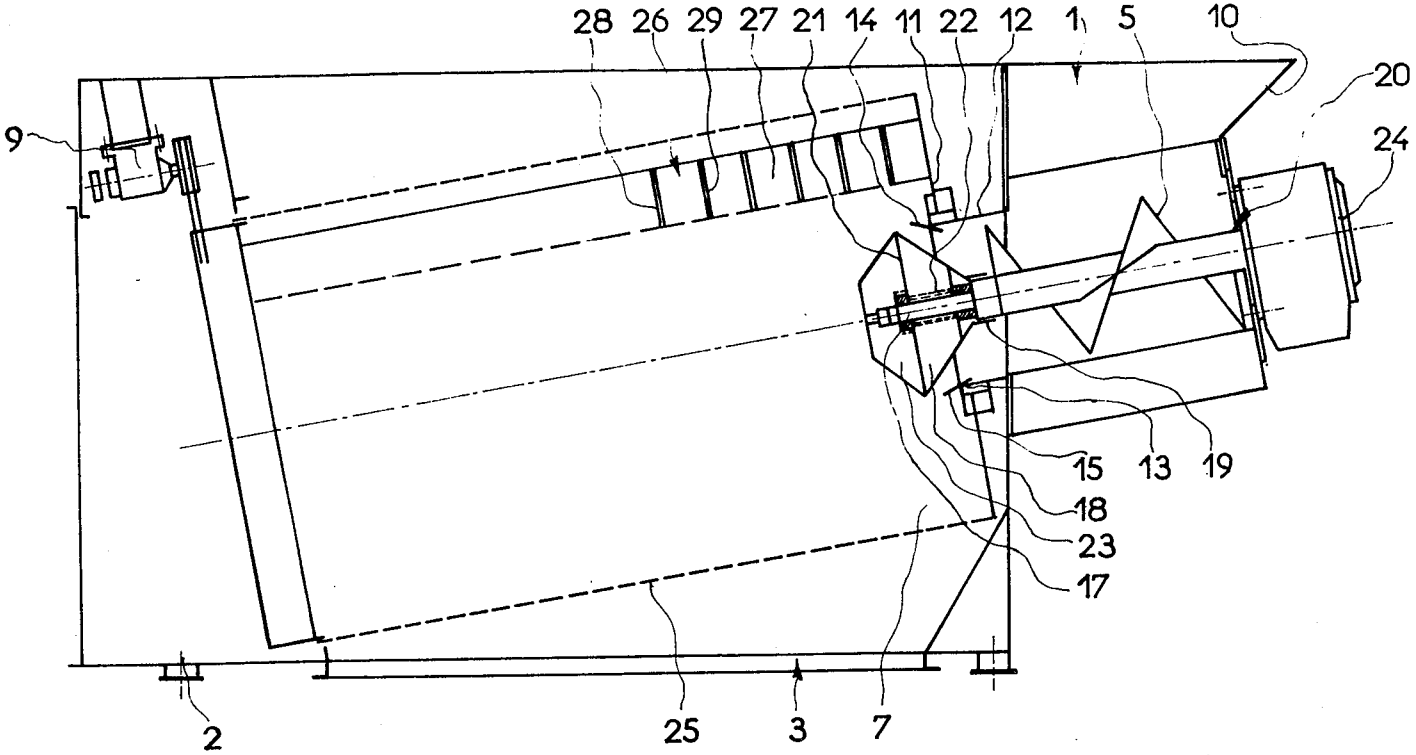
FIG. 1 is an elevational cross-sectional view of one embodiment of apparatus for opening disposable packaging.

The apparatus illustrated in FIG. 1 comprises an inlet 1 including a receiver in which sacks and/or packages are placed. These containers fall onto a screw 5 which displaces them towards a trommel 7, i.e. a cylindrical sieve. Between the receiver 10 and the inlet 11 of the trommel 7, a constriction or neck 12 is provided which cooperates with a screw 5 to ensure forward displacement of the sacks and/or packages. In the trommel 7 the contents (granular products) are separated from the containers. The contents pass through the sieve apertures of the trommel 7, which is rotated by a motor 9, and pass through an outlet 3, while the container, owing to the inclination of the trommel 7, is forwarded to an evacuation opening 2 at the lower end of the trommel 7.

A plurality of cutters 14, 15, 16 (FIG. 4) rotating with the trommel 7 are provided near to the outlet 13 of the neck 12. to ensure contact between the cutters 14, 15, 16 and the containers, it is necessary to slow the forward movement of the containers. To this end, braking means are provided at the end 17 of the screw 5 inside the trommel 7.

The braking means comprises a frustoconical member 18 whose small end 19 faces the beginning 20 of the screw 5 and whose large end 21 is directed towards the interior of the trommel 7. Advantageously, the cutting members 14, 15, 16 are inclined parallel to the outer surface of the member 18. It should be noted that the trommel 7 and the cutting members 14, 15, 16 are rotated in a direction opposite to that of the screw 5. To prevent jamming at the outlet 13 of the neck 12, the member 18 may slide on the end 17 of the screw 5. Resilient telescopic means 22 are arranged inside the member 18 so as to yield under excessive pressure exerted by the sacks and/or packages. Once the said pressure has been absorbed, the telescopic means 22 cause the member 18 to move back to its starting position. The member 18 is joined end to end with an inverted conical member 23 which is designed to protect the telescopic means 22 arranged in the member 18.

The sizes of the sacks and/or packages frequently vary. It is thus necessary to adjust the starting position of the member 18. To this end the assembly of the screw 5 may effect a longitudinal displacement. The means for adjusting the position of the screw are incorporated in the driving means 24 of the screw 5.

Certain products tend to stick to the inside of the container after the container has been torn. It is thus necessary to subject the container to a certain amount of manipulation. Advantageously, the container is repeatedly lifted and dropped onto the lower part 25 of the trommel 7. However, it is necessary to prevent the container from rolling over the contents along the lower part 25 of the trommel 7. To this end, separation and forwarding members are used which comprise a plurality of rakes 26 arranged along the generatrices of the trommel 7. Owing to the space 27 between the successive teeth 28, 29, of each rake, the contents, granular products having variable grain size, are evacuated whereas the container is retained on the teeth 28, 29 and is lifted. Since the trommel 7 and the rakes 26 are inclined, a rake does not lift the container vertically but transversely in the direction of the outlet opening 2. Once the container has reached a certain level, it falls from the rake along a vertical trajectory and is then again transversely displaced repeatedly until it is evacuated through the opening 2.

Figures 2, 3, 4:
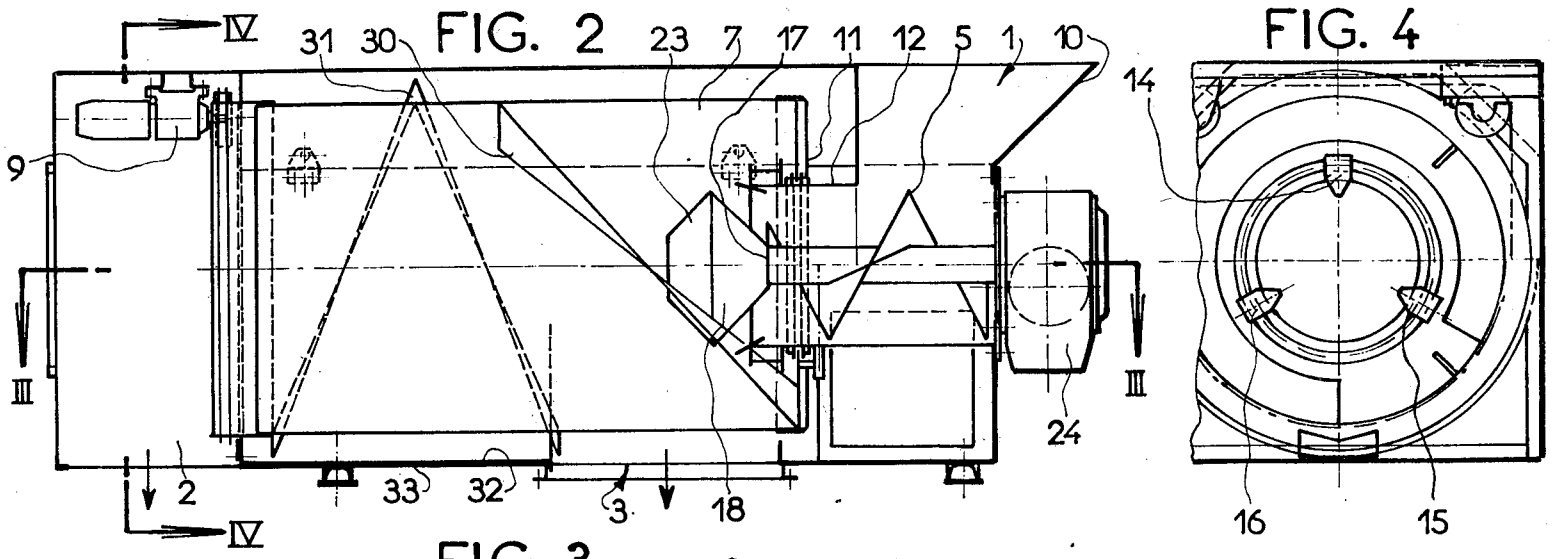
FIG. 2 is an elevational cross-sectional view of another embodiment of apparatus for opening disposable packaging.
FIG. 3 is a partial plan view in cross-section taken along the line III—III of FIG. 2.
FIG. 4 is a partial end view in section taken along the line IV—IV of FIG. 2.

FIGS. 2 to 4 illustrate another embodiment of the apparatus. Since the trommel 7 and the screw 5 shown in FIG. 1 have a given inclination, the above-described apparatus is rather cumbersome. To reduce the overall dimensions, the screw 5 and the trommel 7 are horizontally arranged in FIGS. 2 to 4. In practice, the apparatus comprises the same components as those described above, but without the rakes 26. It is necessary to ensure the displacement of the container and its contents and the separation and displacement members for this purpose are formed by helical members 30, 31. The helical member 30 is disposed inside the trommel 7 and is arranged to displace the container towards the opening 2. The helical member 31 is external and extends around the trommel 7. The contents which have passed through the trommel 7 collect on the bottom 32 of a casing 33. The helical member 31 sweeps the layer of contents thus collected and transfers the contents towards the outlet 3.

I claim:

1. Apparatus for opening packaging comprising disposable containers containing a granular product, said apparatus comprising a trommel, a screw for feeding said containers containing the product into the trommel, means carried by said trommel and located at the inlet of the trommel for rupturing said containers to release the product therefrom, and a frustoconical member located inside the trommel and fixed in rotation with the discharge end of the screw to brake the forward movement of the containers and move the containers radially outwardly to ensure contact of said rupturing means with said containers to release the product, the smaller end of said frustoconical member facing the screw and the larger end being directed toward the interior of the trommel, said trommel having means for separating the ruptured containers and product from each other.

2. Apparatus as claimed in claim 1, in which said product-releasing means comprises cutters having an inclination parallel to that of the conical surface of the frustoconical member and being rigid in rotation with the trommel, the direction of rotation of the trommel being opposite to that of the screw.

3. Apparatus as claimed in claim 1, in which the trommel is inclined and the said separating means comprises rakes arranged inside the trommel along generatrices of the trommel.

4. Apparatus as claimed in claim 1, further comprising an inverted conical member arranged base-to-base with the frustoconical member.

5. Apparatus for opening disposable packaging containing a granular product, comprising a trommel, a screw for feeding the packaging containing the product into the trommel, a frustoconical member located inside the trommel and rigid in rotation with the discharge end of the screw, the smaller end of the frustoconical member facing the screw and the larger end being directed towards the interior of trommel, telescopic means enabling the frustoconical member to move away from the screw in the case of jamming in order to increase the passage area towards the trommel, and means located at the inlet of the trommel and cooperating with the frustoconical member to release the product from the packaging, the trommel having means for separating the packaging and the product from each other.

6. Apparatus for opening disposable packaging containing a granular product, comprising a trommel, a screw for feeding the packaging containing the product into the trommel, a frustoconical member located inside the trommel and rigid in rotation with the discharge end of the screw, the smaller end of the frustoconical member facing the screw and the larger end being directed towards the interior of trommel, and means located at the inlet of the trommel and cooperating with the frustoconical member to release the product from the packaging, the trommel having means for separating the packaging and the product from each other, said separating means comprising two spiral members, one spiral member being disposed inside the trommel for displacing the packaging towards an outlet of the apparatus, and the other spiral member being wound around the outside of the trommel for displacing the product towards another outlet of the apparatus.

* * * * *